US011751695B2

(12) United States Patent
Neuenswander et al.

(10) Patent No.: US 11,751,695 B2
(45) Date of Patent: Sep. 12, 2023

(54) BEDDING PRODUCT WITH ANGLED WEDGES FOR TILT FEATURE

(71) Applicant: L&P Property Management Company, South Gate, CA (US)

(72) Inventors: Jacob J. Neuenswander, Carthage, MO (US); Daniel W. Williams, Webb City, MO (US); Charles A. Whitledge, Sarcoxie, MO (US)

(73) Assignee: L&P Property Management Company, South Gate, CA (US)

( * ) Notice: Subject to any disclaimer, the term of this patent is extended or adjusted under 35 U.S.C. 154(b) by 232 days.

(21) Appl. No.: 17/385,334

(22) Filed: Jul. 26, 2021

(65) Prior Publication Data

US 2023/0025691 A1 Jan. 26, 2023

(51) Int. Cl.

| | |
|---|---|
| ***A47C 20/10*** | (2006.01) |
| ***A47C 19/02*** | (2006.01) |
| ***A47C 19/04*** | (2006.01) |

(52) U.S. Cl.

CPC ..... *A47C 20/10* (2013.01); *A47C 19/024* (2013.01); *A47C 19/045* (2013.01)

(58) Field of Classification Search

CPC ..... A47C 20/00; A47C 20/10; A47C 19/024; A47C 19/045; A47C 20/08

See application file for complete search history.

(56) References Cited

U.S. PATENT DOCUMENTS

| | | | | |
|---|---|---|---|---|
| 6,301,732 | B1 * | 10/2001 | Smith | A47C 19/024 5/660 |
| 9,993,089 | B1 * | 6/2018 | Tavares | A47C 19/025 |
| 2008/0000027 | A1 * | 1/2008 | Clenet | A47C 20/041 5/200.1 |
| 2010/0242171 | A1 * | 9/2010 | Polevoy | A47C 19/005 5/282.1 |
| 2011/0173751 | A1 * | 7/2011 | Beaton | A47C 19/045 5/509.1 |
| 2016/0007759 | A1 * | 1/2016 | Polevoy | A47C 19/005 5/400 |
| 2020/0049183 | A1 * | 2/2020 | Zerillo | A47C 19/005 |

* cited by examiner

*Primary Examiner* — Fredrick C Conley

(74) *Attorney, Agent, or Firm* — Wood Herron & Evans LLP

(57) ABSTRACT

A bedding product such as an adjustable bed comprises a stationary frame which is inclined regardless of the position of the adjustable bed. The stationary frame is supported by multiple leg assemblies of different heights. Due to wedges sandwiched between the leg assemblies and mounting brackets of the stationary frame, the leg assemblies remain flat on the ground providing a stable support for the bedding product. Each leg assembly is secured to one of the mounting brackets.

20 Claims, 13 Drawing Sheets

BEDDING PRODUCT WITH ANGLED WEDGES FOR TILT FEATURE

FIELD OF THE INVENTION

This invention relates generally to bedding products such as bedding foundations and adjustable bed bases.

BACKGROUND OF THE INVENTION

Conventional bedding products often have a rectangular frame comprising two opposed side rails with a plurality of cross support members, or slats, extending across the side rails for supporting a box spring or foundation. Bed frames, for example, may further include several other components such as support leg assemblies which are usually secured to the side rails or cross members to support the bed frame about the floor. Such bed frames are typically manufactured and shipped to various retail outlets for offering to end consumers.

Adjustable bed bases are another bedding product having a rectangular frame. A deck or platform comprising multiple planks or boards hinged to each other for movement is attached to the rectangular frame. Leg assemblies are commonly attached to the frame to raise the adjustable bed base off the floor. Usually one or more motors underneath the platform cause lifting members to raise one or more of the planks or boards, which raises one or both ends of a mattress supported by the adjustable bed base platform.

Sometimes customers wish to incline a bedding product such that the head end of the bedding product is above the foot end of the bedding product. Some situations in which such an incline would be desirable include if the person using the bedding product is ill or wants to eliminate snoring. Alternatively, sometimes customers wish to raise the foot end of the bedding product is above the head end of the bedding product for medical or personal reasons.

Therefore, it would be desirable to be able to keep the frame of a bedding product like an adjustable bed base or a bed frame at an inclined position. In the case of an adjustable bed base it would be desirable to keep the frame of the adjustable bed base at an inclined position when the deck or platform of the adjustable bed base is flat or planar.

Manufacturers attempt to package the bed frames in an efficient and cost-effective manner. This often requires that various components of the bed frames be packaged in an unassembled state such that subsequent assembly is required before the consumer may use the bed frame. By way of example, the support legs may not come assembled to the bed frame. As a result, the practice of shipping such components separately, in an unassembled state, involves considerable amounts of time and cost for both the manufacturer and end-user.

Conventional assembly of a bed frame, for example, often requires hardware and tools, such as wrenches, screw drivers, etc. Accordingly, proper assembly relies on the retailer or consumer having the proper tools readily accessible. It can be frustrating when the person starts assembling the bed frame but then learns that they lack the proper tools required to complete the assembly. Moreover, proper assembly of the bed frame may be dependent on the skill set of the person performing the assembly. Thus, even with the correct tools, proper assembly of the bed frame may not be achieved. The improper assembly of the bed frame may frustrate the customer and result in negative product perception, phone calls or other communications from unsatisfied consumers, or product return and a demand for a refund.

In view of the above, there is an increasing need for manufacturers to provide bedding products that are easy to assemble and require a minimum number of tools.

It is therefore an objective of this invention to provide a bedding product which may be shipped in a partially assembled state with leg assemblies which may be attached to the bedding frame with wedges therebetween to keep the bedding product in an inclined position.

It is further an objective of this invention to provide a bedding product having adjustable leg assemblies, where a wedge may be sandwiched between each leg assembly and the frame of a bedding product without tools to keep the frame in an inclined position.

It is further an objective of this invention to provide a bedding product having adjustable legs and wedges which may be removed for shipping and storage and secured to a frame of a bedding product without tools.

SUMMARY OF THE INVENTION

According to one aspect of the invention, an adjustable bed base comprises a stationary frame having multiple mounting brackets secured thereto. The stationary frame may comprise opposed side members, a head end member extending between the opposed side members and a foot end member extending between the opposed side members. The mounting brackets may be secured to the stationary frame in any manner such as by welding for example.

The adjustable bed base further comprises multiple leg assemblies. Each of the leg assemblies is secured to one of the mounting brackets at an upper end and has a lower end resting on a supporting surface. Each of the leg assemblies may be adjustable in length. In one embodiment, two of the leg assemblies have a first length, two additional leg assemblies have a second length longer than the first length and two more leg assemblies have a third length longer than the second length.

The adjustable bed base further comprises multiple wedges. Each of the wedges comprises a floor having an opening through the floor and lips extending upwardly from the floor on opposite sides of the floor to help keep the wedge stationary relative to the mounting backet. An opening extends through the floor of the wedge to allow a portion of one of the leg assemblies to pass through the opening and engage one of the mounting brackets. Each of the wedges is sandwiched between one of the leg assemblies and one of the mounting brackets. The wedges incline the stationary frame relative to a support surface or floor. The wedges further keep a bottom surface of each of the leg assemblies flat on the support surface regardless of the length of the leg assembly which provides increased stability to the adjustable bed base. The adjustable bed base remains in an inclined position regardless of the position of the adjustable bed.

The adjustable bed base further comprises a deck comprising multiple deck members hinged to each other. At least one of the deck members is secured to the stationary frame and remains stationary regardless of the positions of the other deck members. Motors function to move the deck members to adjust the position of a mattress supported by the deck. For example, a head end of the mattress may be raised above a lumbar portion of the mattress. Alternative or additionally, a foot end of the mattress may be lowered to raise the knees of someone laying down on the mattress. Due to the wedges of the present invention, when the deck is generally planar and supported by the stationary frame, both the deck and stationary frame are inclined at an angle and not horizontal. In most applications, the angle of inclination is at least two degrees. In other words, the stationary frame has a head end and a foot end, one of the head and foot ends being higher than the other of the head and foot ends regardless of the position of the deck members. An angle defined between a plane extending between the head and foot ends of the stationary frame and a horizonal plane would be at least two degrees.

In another aspect of the invention, the adjustable bed base comprises a stationary frame including multiple mounting brackets. The adjustable bed base further comprises multiple legs. Each of the legs is secured to one of the mounting brackets at an upper end and has a lower end resting on a supporting surface. Each of the legs may be adjustable in length. In one embodiment, the adjustable bed base has six legs. Two of the legs have a first length, two additional legs have a second length greater than the first length and two more legs have a third length greater than the second length. In any of the embodiments, any number of legs such as four or eight may be supported by the frame of the adjustable bed base.

The adjustable bed base further comprises multiple wedges. Each of the wedges comprises a floor having an opening through the floor and lips extending upwardly from the floor on opposite sides of the floor to help keep the wedge stationary relative to the mounting backet. An opening extends through the floor of the wedge to allow a portion of one of the legs to pass through the opening and engage one of the mounting brackets. Each of the wedges is sandwiched between one of the legs and one of the mounting brackets. The wedges incline the stationary frame relative to a support surface or floor. The wedges further keep a bottom surface of each of the legs flat on the support surface regardless of the length of the leg which provides increased stability to the adjustable bed base. The adjustable bed base remains in an inclined position regardless of the position of the adjustable bed.

The adjustable bed base further comprises a deck comprising multiple deck members hinged to each other. At least one of the deck members is secured to the stationary frame and remains stationary regardless of the positions of the other deck members. Motors function to move the deck members to adjust the position of a mattress supported by the deck. For example, a head end of the mattress may be raised above a lumbar portion of the mattress. Alternative or additionally, a foot end of the mattress may be lowered to raise the knees of someone laying down on the mattress. Due to the wedges of the present invention, when the deck is generally planar and supported by the stationary frame, both the deck and stationary frame are inclined at an angle and not horizontal. In most applications, the angle of inclination is at least two degrees. In other words, the stationary frame has a head end and a foot end, one of the head and foot ends being higher than the other of the head and foot ends regardless of the position of the deck members. An angle defined between a plane extending between the head and foot ends of the stationary frame and a horizonal plane would be at least two degrees.

According to another aspect of the invention, an adjustable bed movable between multiple positions is provided. The adjustable bed comprises an adjustable bed base having an inclined stationary frame. In one embodiment, the inclined stationary frame comprises opposed side members, a head end member extending between the opposed side members and a foot end member extending between the opposed side members. The inclined stationary frame further comprises multiple mounting brackets, each of the mounting brackets being secured to the inclined stationary frame.

The adjustable bed base further comprises multiple leg assemblies. Each of the leg assemblies is secured to one of the mounting brackets. The leg assemblies may be different lengths.

The adjustable bed base further comprises multiple wedges. Each of the wedges is sandwiched between one of the leg assemblies and one of the mounting brackets to incline the stationary frame relative to a planar support surface regardless of the position of the adjustable bed. Each of the wedges is identically formed and generally U-shaped having a floor with an opening through the floor and lips extending upwardly from the floor. The lips of the wedge engage one of the mounting brackets of the adjustable bed base to keep the wedge stationary. A portion of each leg assembly passes through the opening in the floor of the wedge and engages one of the mounting brackets.

The adjustable bed further comprises a deck comprising multiple deck members hinged together. At least one of the deck members is secured to the stationary frame is it too is stationary regardless of the positions of the other deck members. The other deck members are moved by operation of motors secured to the stationary frame of the adjustable bed.

The accompanying drawings, which are incorporated in and constitute part of this specification, illustrate embodiments of the invention and, together with the summary of the invention given above, and the detailed description of the drawings given below, explain the principles of the present invention.

DETAILED DESCRIPTION OF THE INVENTION

Figure 1:
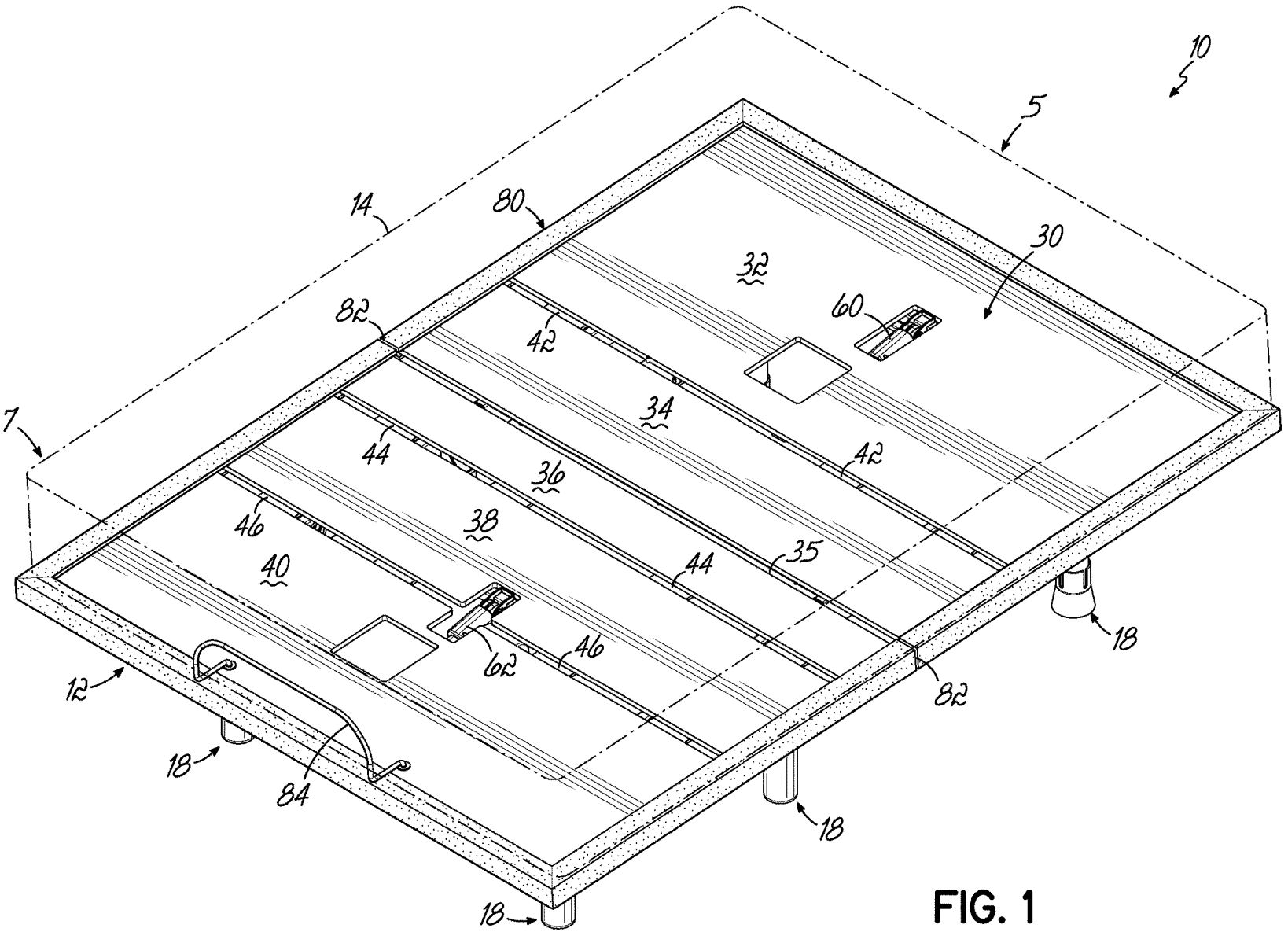
FIG. 1 is a top perspective view of an adjustable bed constructed in accordance with the present invention.
Figure 2:
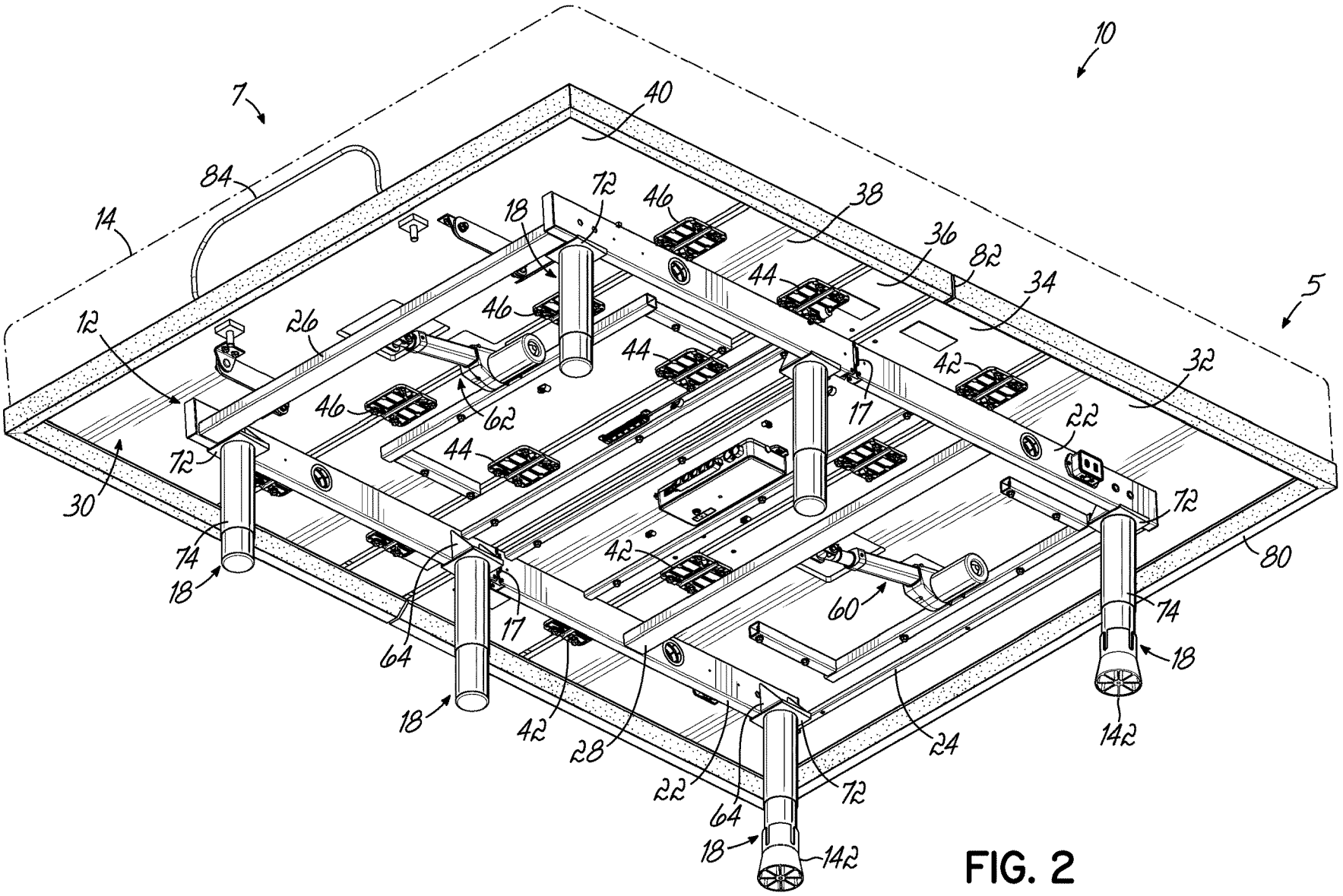
FIG. 2 is a bottom perspective view of the adjustable bed of FIG. 1 showing an adjustable bed base supported by six adjustable leg assemblies.

Referring to FIG. 1, there is illustrated an adjustable bed 10, including an adjustable bed base 12 for supporting a mattress 14. The mattress 14 is shown in dashed lines. The adjustable bed 10 has a head end 5 and a foot end 7. As best shown in FIG. 2, the adjustable bed base 12 comprises a generally rectangular, stationary frame 16 supported by six leg assemblies 18. In any of the embodiments, any number of leg assemblies 18 such as four or eight may be supported by the stationary frame 16 of the adjustable bed base 12.

Figure 10:
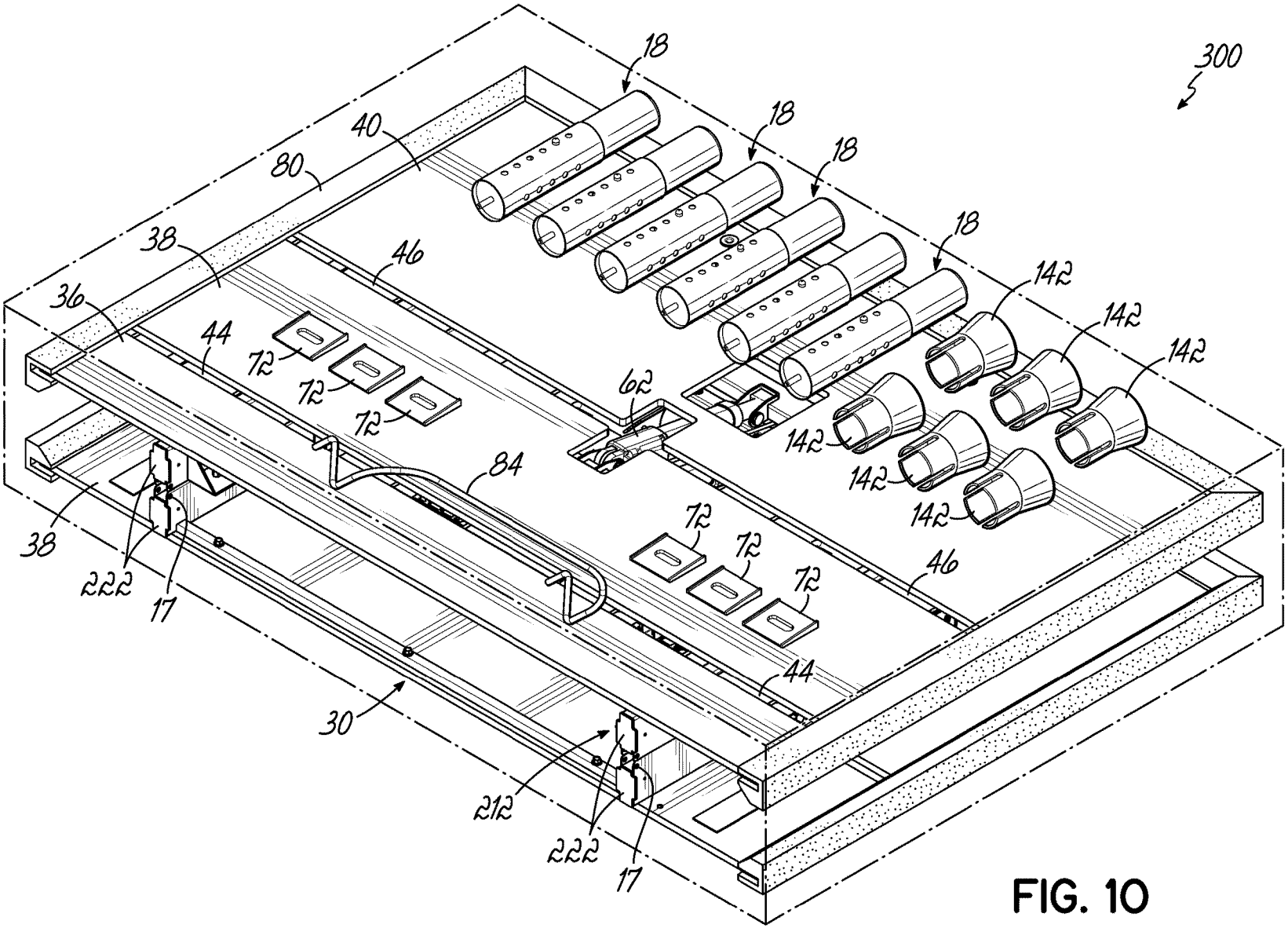
FIG. 10 is a perspective view of a shippable container with the adjustable bed 10 therein ready to be assembled.

As best shown in FIG. 2, the generally rectangular frame 16 of the adjustable bed base 12 comprises two side members 22, a head member 24 extending between the side members 22, a foot member 26 extending between the side members 22 and an intermediate member 28 extending between the side members 22. Each of the side members 22 is hinged with hinge 17 to enable the adjustable bed base 12 to fold for shipping purposes as shown in FIG. 10.

As best shown in FIGS. 1 and 2, the adjustable bed base 12 further comprises a deck 30 comprising a head deck board 32, a first lumbar deck board 34, a second lumbar deck board 36, a thigh deck board 38 and a foot deck board 40. As best shown in FIG. 2, the head deck board 32 is joined to the first lumbar deck board 34 with three hinges 42 secured to lower surfaces of the first lumbar deck board 34 and head deck board 32. The first lumbar deck board 34 is stationary and secured to the side members 22 of the generally rectangular frame 16 of the adjustable bed base 12. Similarly, the second lumbar deck board 36 is stationary and secured to the side members 22 of the generally rectangular frame 16 of the adjustable bed base 12. The first lumbar deck board 34 is separated from the second lumbar deck board 36 with a gap 35 to allow the adjustable bed base 12 to fold or collapse into two parts for shipping purposes as shown in FIG. 10. One deck board may be used in place of the first and second lumbar deck boards in some embodiments.

As best shown in FIG. 2, the second lumbar deck board 36 is joined to the thigh deck board 38 with three additional hinges 44 secured to lower surfaces of the second lumbar deck board 36 and thigh deck board 38. Lastly, the thigh deck board 38 is joined to the foot deck board 40 with three additional hinges 46 secured to lower surfaces of the thigh deck board 38 and foot deck board 40.

Figure 3:
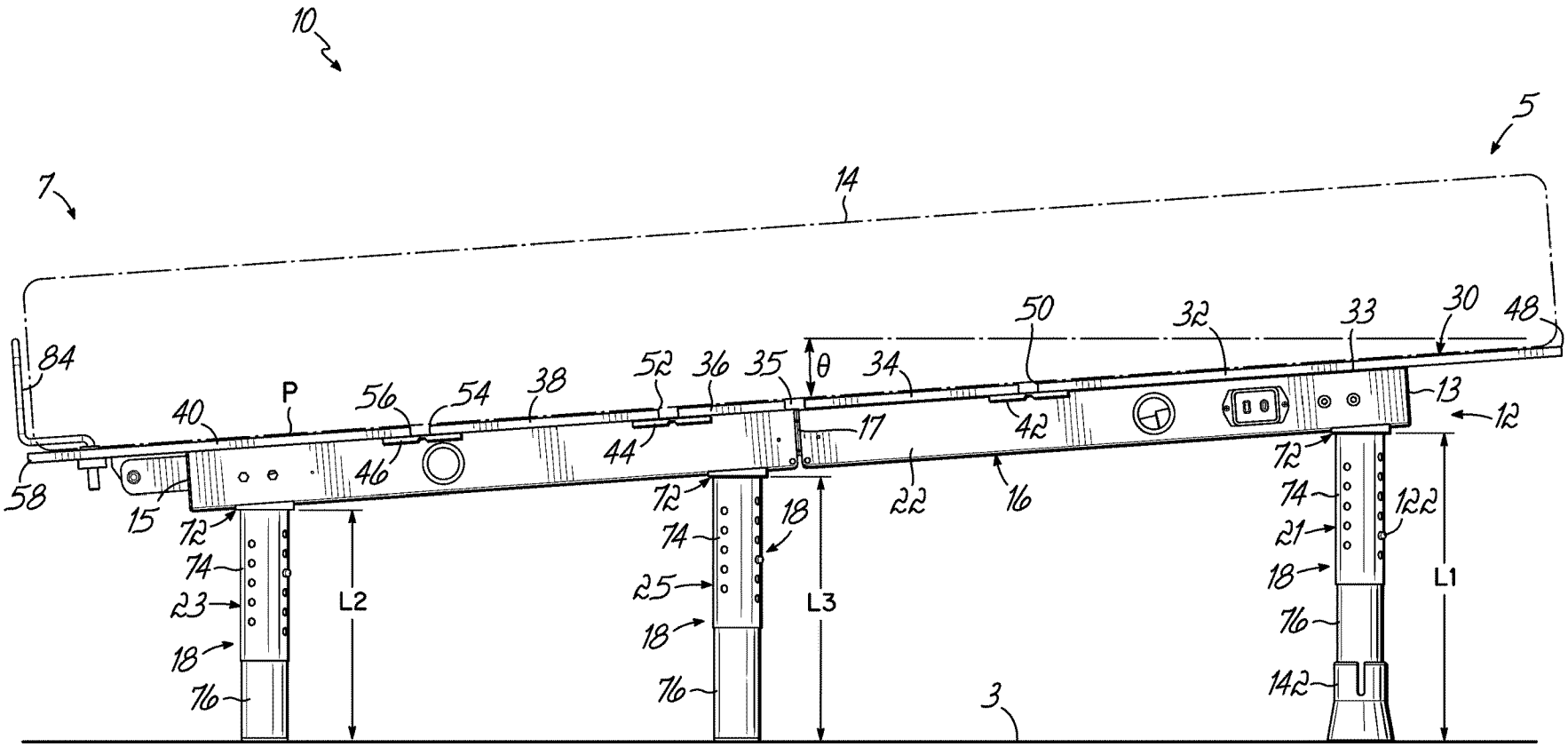
FIG. 3 is a side view of the adjustable bed of FIG. 1, showing the inclined stationary frame of the adjustable bed base of the adjustable bed of FIG. 1 with the deck in a down or flat position.
Figure 3A:
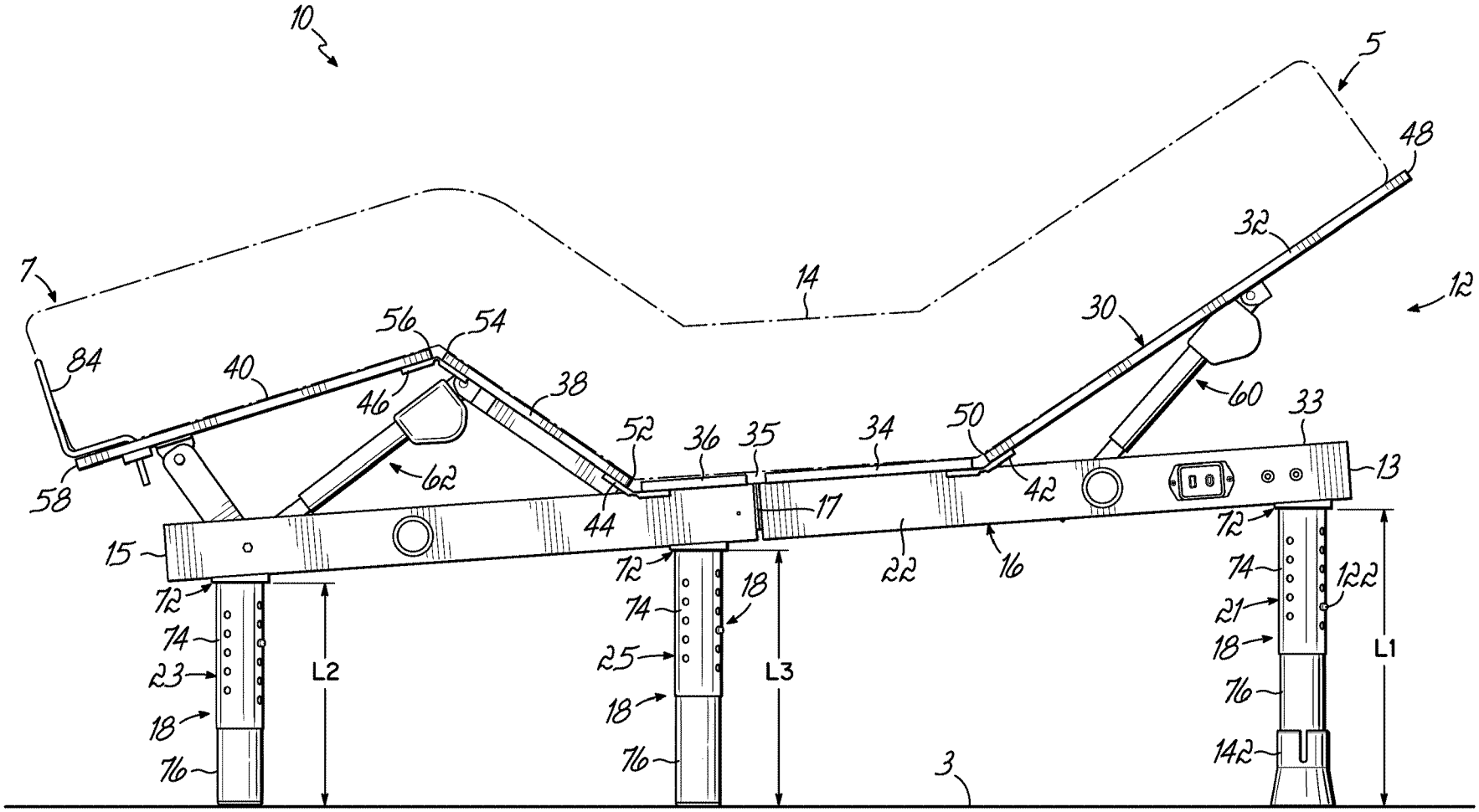
FIG. 3A is a side view of the adjustable bed of FIG. 1, showing the inclined stationary frame of the adjustable bed base of the adjustable bed of FIG. 1 with the deck in a fully inclined position.

The deck 30 is movable between a flat position shown in FIG. 2 and a fully adjusted position shown in FIG. 3A. When the deck 30 is in its flat position, the deck boards 32, 34, 36, 38 and 40 are generally co-planar and rest on top of an upper surface 33 of the side members 22 of the generally rectangular frame 16 of the adjustable bed base 12. As best shown in FIG. 3, when the deck 30 is in its flat position, the aligned deck boards 32, 34, 36, 38 and 40 are generally co-planar in a plane P which is inclined at an angle 8 to a horizontal plane. The angle 8 may be any number but is typically between two and four degrees due to the construction of the wedges 72, 72' described below.

As shown in FIG. 3A, in the deck's fully adjusted position, the head deck board 32 is inclined, the front edge 48 of the head deck board 32 being above the rear edge 50 of the head deck board 32 due to operation of a motorized linear actuator 60. Regardless of the deck's position, the first lumbar deck board 34 and second lumbar deck board 36 are stationary and secured to the side members 22 of the generally rectangular frame 16 of the adjustable bed base 12. In the deck's fully adjusted position shown in FIG. 3A, the thigh deck board 38 is inclined, the front edge 52 of the thigh deck board 38 being below the rear edge 54 of the thigh deck board 38 due to operation of a motorized linear actuator 62. In the deck's fully adjusted position, the foot deck board 40 is inclined, the front edge 56 of the foot deck board 40 being above the rear edge 58 of the foot deck board 40 as seen in FIG. 3A.

Although not shown, only one of the two linear actuators 60, 62 may be activated such that only a portion of the deck 30 is inclined. As best shown in FIG. 1, a foam border 80 surrounds the deck 30 for protection. As shown in FIG. 1, the foam border 80 has gaps 82 therein to enable the adjustable bed base 12 to be folded in half for shipping purposes. See FIG. 10. As is conventional in adjustable beds, a generally U-shaped mattress stop 84 is secured to the foot deck board 40 to prevent the mattress 14 from moving relative to the adjustable bed base 12.

Figure 4A:
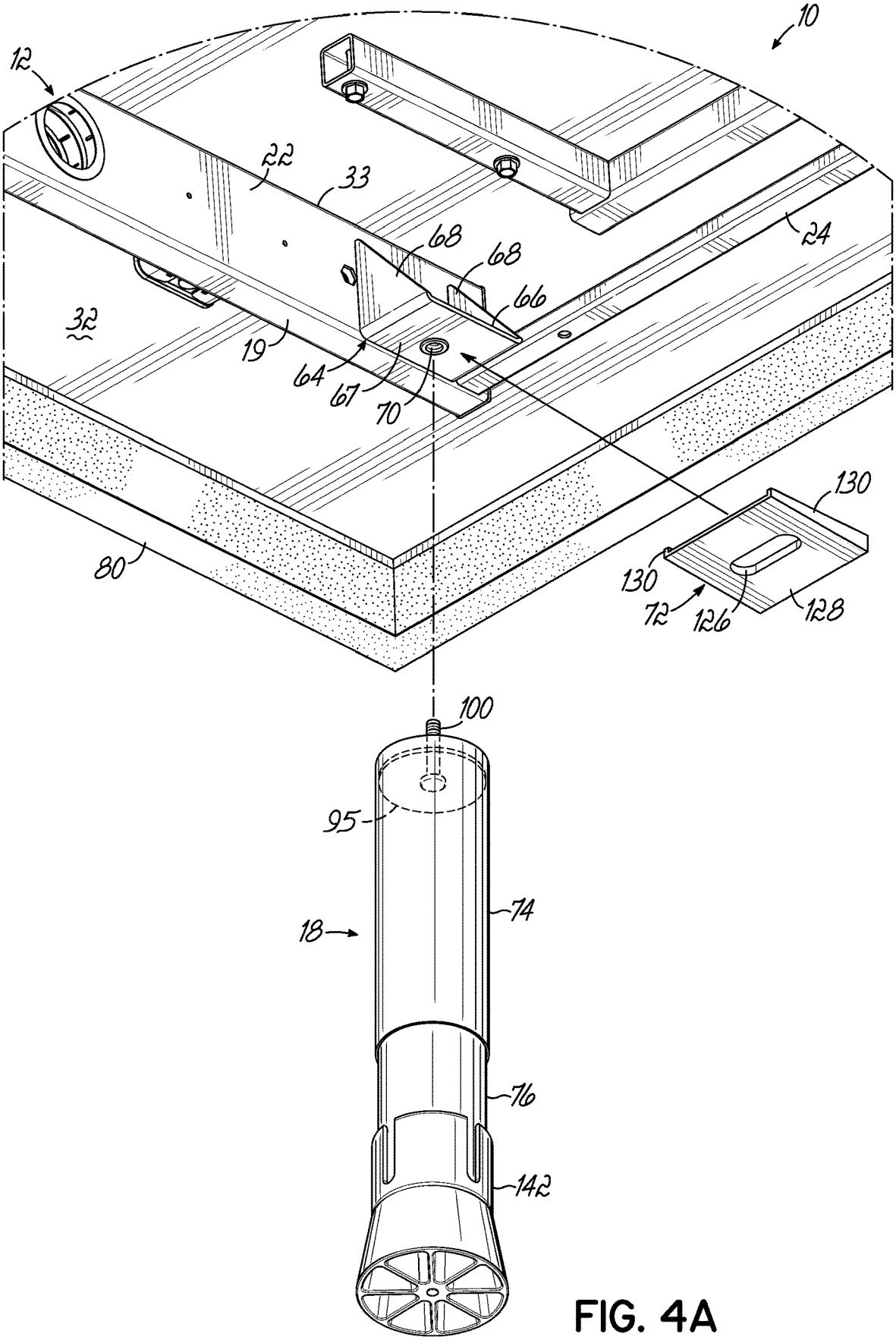
FIG. 4A is an enlarged bottom perspective view of a portion of the adjustable bed of FIG. 1, showing one of the leg assemblies being secured to the stationary frame of the adjustable bed base.
Figure 4B:
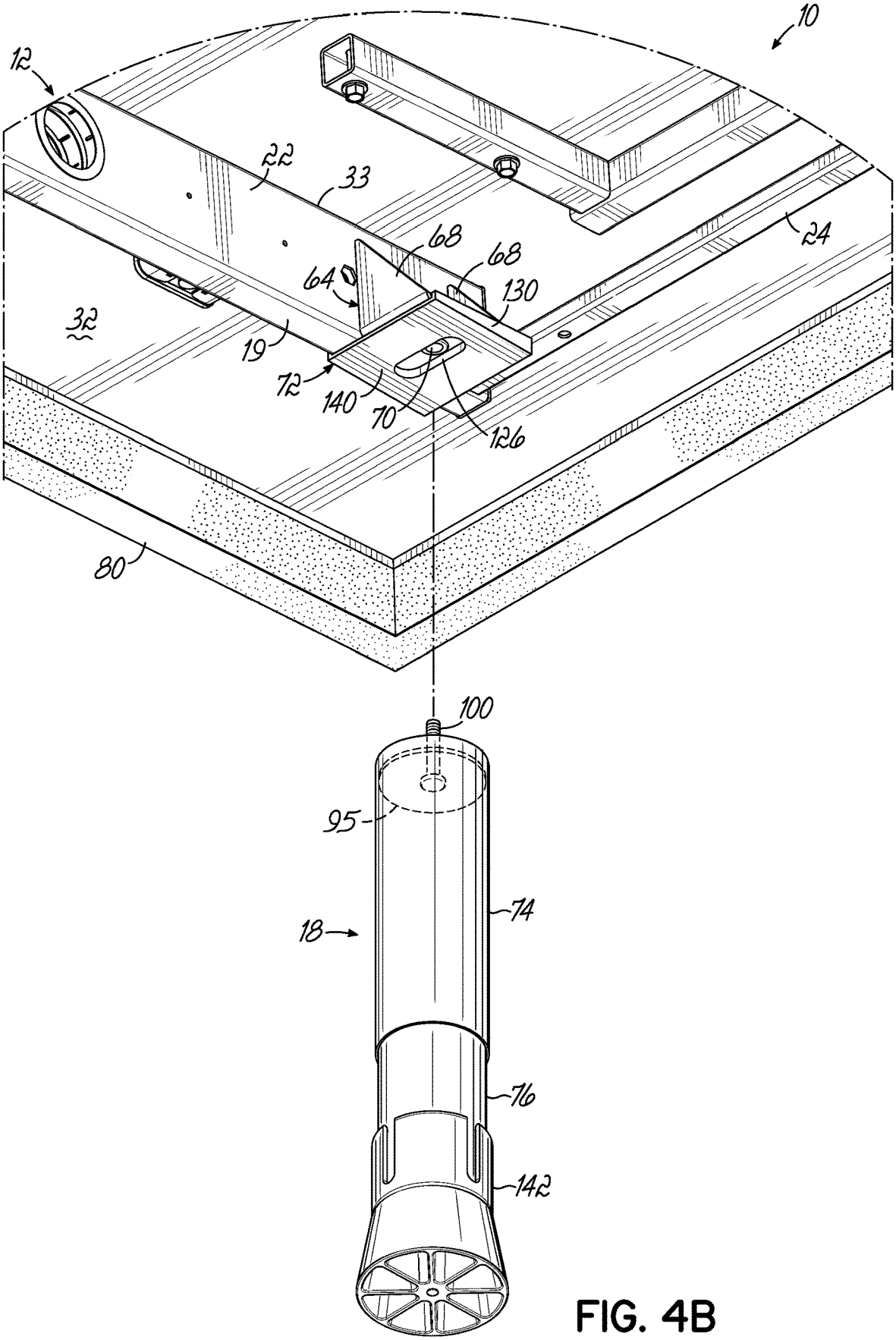
FIG. 4B is an enlarged bottom perspective view of the portion of the adjustable bed of FIG. 1 shown in FIG. 4A, showing one of the leg assemblies being further secured to the stationary frame of the adjustable bed base.

As best shown in FIGS. 2, 4A and 4B, the generally rectangular frame 16 of the adjustable bed base 12 further comprises six mounting brackets 64 welded to the side members 22 of the generally rectangular frame 16. As best shown in FIG. 2, three of the mounting brackets 64 are welded to each side member 22 of the generally rectangular frame 16.

FIGS. 4A and 4B illustrate one of the front corners at the head end 5 of the generally rectangular frame 16. As best shown in FIGS. 4A and 4B, each of the mounting brackets 64 is a generally U-shaped unitary member. Each of the mounting brackets 64 comprises a generally planar floor 66 and two side walls 68 extending upwardly from the generally planar floor 66. As best shown in FIG. 4A, the generally planar floor 66 of the mounting bracket 64 has a lower surface 67 which is coplanar with the lower surface 19 of the side member 22 of the generally rectangular frame 16. The side walls 68 of the mounting bracket 64 are perpendicular to the generally planar floor 66 of the mounting bracket 64.

Figure 6:
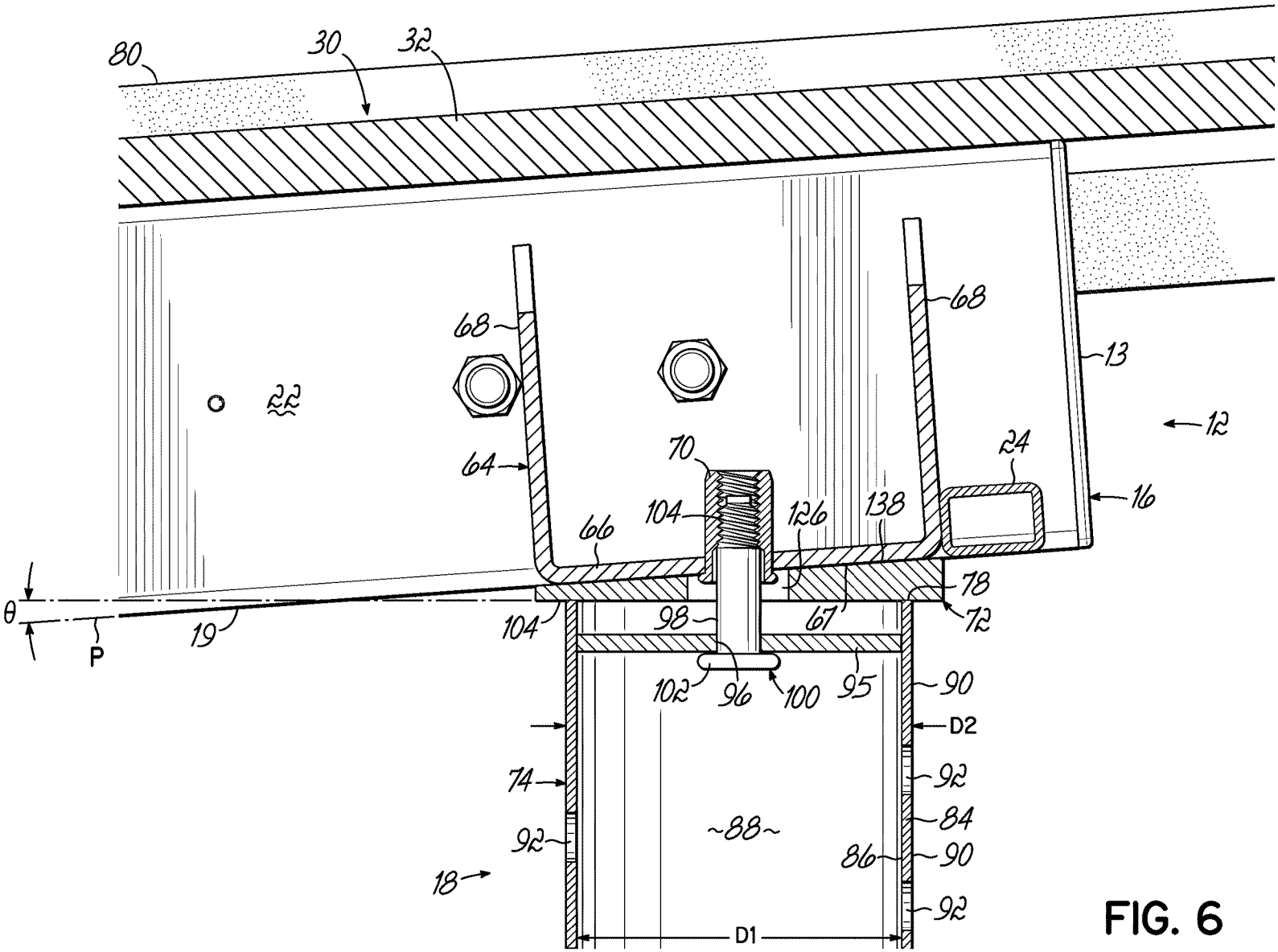
FIG. 6 is an enlarged view of a portion of FIG. 5 showing a connection between the leg assembly and the stationary frame of the adjustable bed base.

As best illustrated in FIG. 6, a threaded boss 70 is welded or otherwise secured to the generally planar floor 66 of the mounting bracket 64. The threaded boss 70 extends upwardly from the generally planar floor 66 of the mounting bracket 64. Each of the side walls 68 is generally triangular. Because each of the mounting brackets 64 is welded to one of the side members 22 of the generally rectangular frame 16, the mounting brackets 64 may be considered part of the generally rectangular frame 16 of the adjustable bed base 12.

However, the mounting brackets 64 may be removably secured to the side members 22 of the generally rectangular frame 16 of the adjustable bed base 12 in which case the mounting brackets 64 would not be considered integral parts of the generally rectangular frame 16 of the adjustable bed base 12.

As best shown in FIG. 2, a leg assembly 18 is secured to each of the mounting brackets 64 of the generally rectangular frame 16 with a wedge 72 therebetween. The location of the mounting brackets 64 is not intended to be limited by the drawings; the mounting brackets 64 may be secured to other portions of the generally rectangular frame 16. As best shown in FIG. 2, the adjustable bed 10 has six mounting brackets 64, six wedges 72 and six leg assemblies 18.

Figure 7:
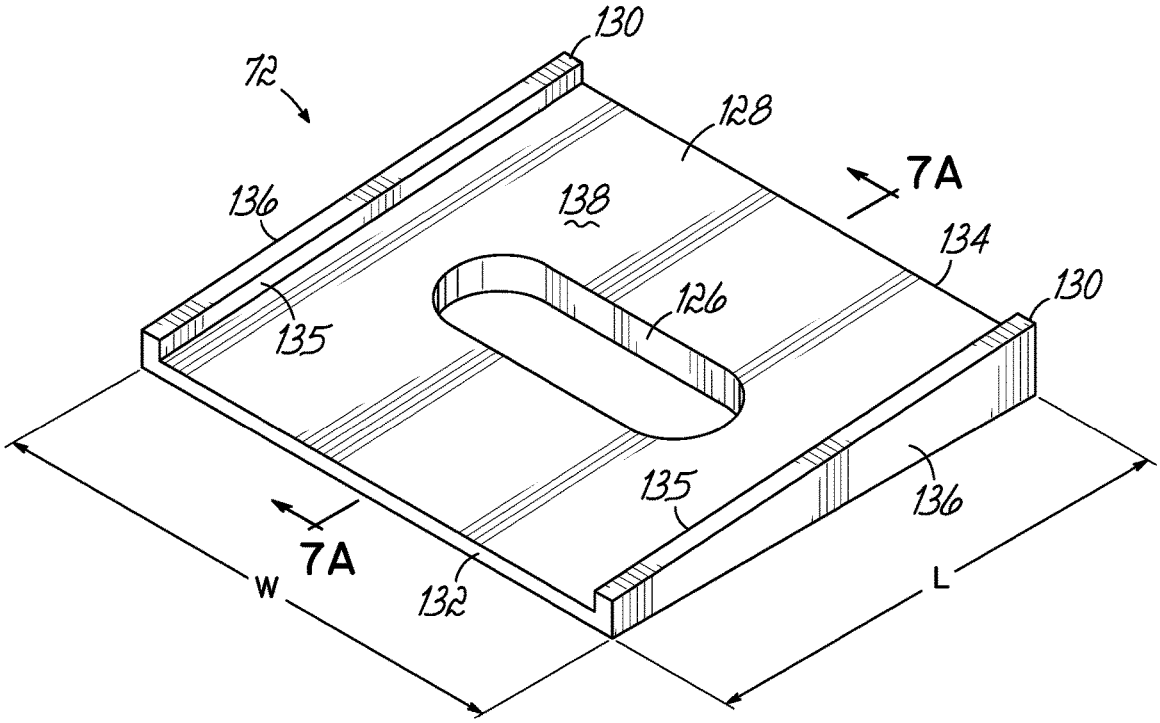
FIG. 7 is a perspective view of a wedge according to one embodiment of the invention.
Figure 7A:
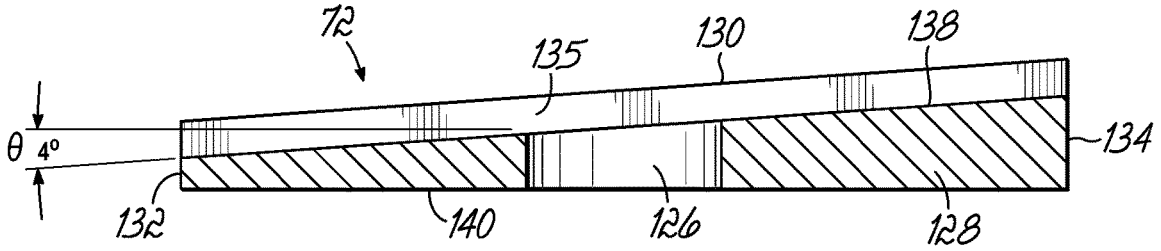
FIG. 7A is a cross-sectional view taken along the line 7A-7A of FIG. 7.

As shown in FIGS. 7 and 7A, one embodiment of wedge 72 is a unitary member comprising a main portion 128 and two wings 130 extending upwardly from the main portion 128. An oval shaped opening 126 extends through the main portion 128 of the wedge 72, as best shown in FIG. 7. The wedge 72 has a generally U-shaped front surface 132 and a generally U-shaped rear surface 134. Each of the wings 130 of wedge 72 has an inner surface 135 and outer surface 136. The wedge 72 has a length L defined as the linear distance between the front and rear surfaces 132, 134, respectively. The wedge 72 has a uniform width W defined as the linear distance between outer surfaces 136 of the wings 130, as shown in FIG. 7. The main portion 128 of the wedge 72 has an upper surface 138 which slopes downwardly from back to front. The wedge 72 has a planar bottom surface 140. As shown in FIG. 7A, a plane defined by the upper surface 138 of the main portion 128 of wedge 72 forms an angle 8 to the horizontal plane defined by the bottom surface 140 of wedge 72. The angle 8 may be any number but is typically between two and four degrees. In one preferred embodiment, the angle 8 is four degrees, as shown in FIG. 7A. As best shown in FIG. 7A, the main portion 128 of the wedge 72 decreases in thickness moving in the forward direction from the rear surface 134 to the front surface 132 of the wedge 72. Thus, the main portion 128 of the wedge 72 has a tapered thickness, decreasing from back to front.

Figure 7B:
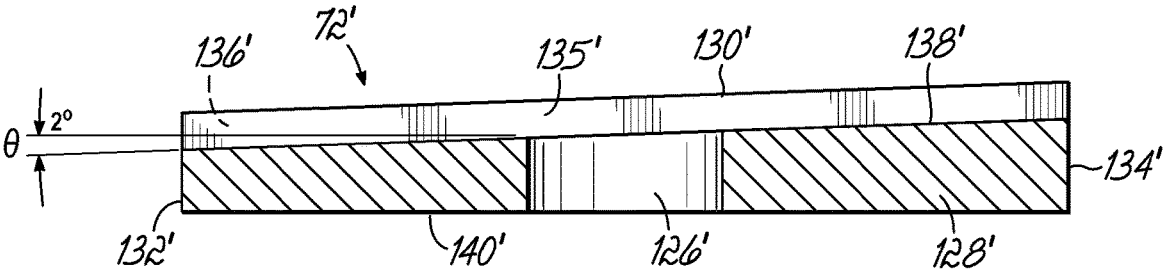
FIG. 7B is a cross-sectional view like FIG. 7A of an alternative wedge.

In another preferred embodiment, the angle 8 is two degrees as shown in wedge 72' of FIG. 7B. For simplicity like numbers represent like parts but with a prime after the number representing the part. Wedge 72' is a unitary member comprising a main portion 128' and two wings 130' extending upwardly from the main portion 128'. An oval shaped opening 126' extends through the main portion 128' of the wedge 72'. The wedge 72' has a generally U-shaped front surface 132' and a generally U-shaped rear surface 134'. Each of the wings 130' of wedge 72' has an inner surface 135' and outer surface 136'. The wedge 72' has a length L defined as the linear distance between the front and rear surfaces 132', 134', respectively. The wedge 72' has a uniform width W defined as the linear distance between outer surfaces 136' of the wings 130'. The main portion 128' of the wedge 72' has an upper surface 138' which slopes downwardly from back to front. The wedge 72' has a planar bottom surface 140'. As shown in FIG. 7B, a plane defined by the upper surface 138' of the main portion 128' of wedge 72' forms an angle 8 to the horizontal plane defined by the bottom surface 140' of wedge 72'.

Figure 5:
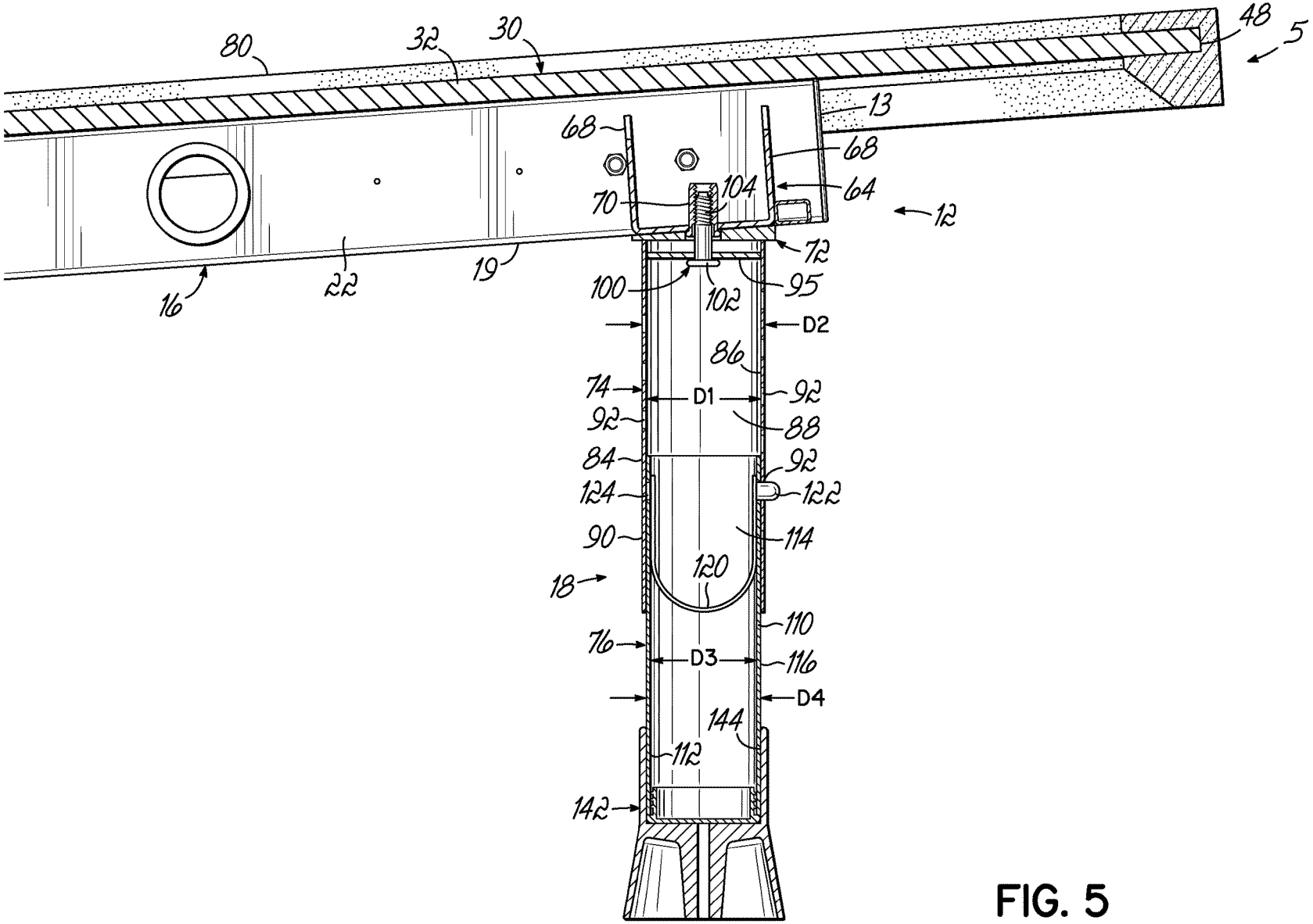
FIG. 5 is a cross-sectional view of the leg assembly of FIGS. 4A and 4B secured to the stationary frame of the adjustable bed base.
Figure 8:
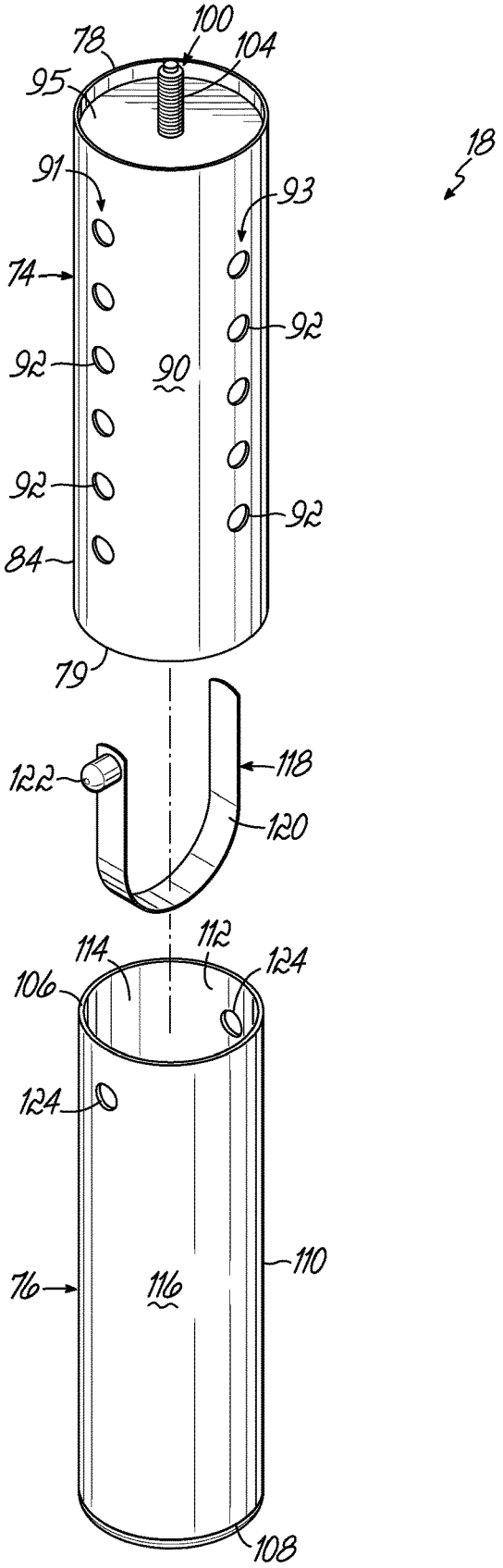
FIG. 8 is a partially disassembled view of one of the leg assemblies.

As best shown in FIG. 8, each leg assembly 18 has an adjustable length. Each leg assembly 18 includes a receiver 74 and a lower member 76. As shown in FIG. 8, the receiver 74 has an upper edge 78, which abuts or otherwise contacts the lower surface 140 of wedge 72 upon assembly and a lower edge 79. As best shown in FIG. 6, receiver 74 comprises a wall 84 having an interior surface 86 defining a hollow interior 88 therein and an exterior surface 90. As shown in FIGS. 5 and 6, receiver 74 has an inner diameter D1 and an outer diameter D2. Thus, the receiver 74 has a generally cylindrical shape. As best shown in FIG. 8, receiver 74 has two rows 91, 93 of aligned holes 92, each hole 92 extending through the wall 84 of the receiver 74. Although six aligned holes 92 are illustrated in row 91 and five aligned holes 92 are illustrated in row 93, the receiver 74 may have any desired number of holes or openings of any desired shape in either row.

As best shown in FIG. 6, at an upper portion of the receiver 74, a washer 95 is secured inside the hollow interior 88 of the receiver 74 via welding, for example. As best shown in FIG. 6, washer 95 has a central opening 96 therein through which passes a shaft 98 of a fastener 100. The fastener 100 has a head 102 below the opening 96 of washer 95. See FIGS. 6 and 8. The shaft 98 of fastener 100 has external threads 104, the function of which is described below.

As best shown in FIG. 8, each leg assembly 18 further comprises a lower member 76 having an upper edge 106 and a lower edge 108. As best shown in FIGS. 5 and 8, lower member 76 comprises a wall 110 having an interior surface 112 defining a hollow interior 114 therein and an exterior surface 116. As shown in FIGS. 5 and 8, lower member 76 has an inner diameter D3 and an outer diameter D4. Thus, the lower member 76 has a generally cylindrical shape. As shown in FIG. 5, the outer diameter D4 of the lower member 76 is slightly less than the inner diameter D1 of receiver 74 so the lower member 76 may fit inside the hollow interior 88 of the receiver 74.

As best shown in FIG. 8, each leg assembly 18 further comprises a push pin assembly 118 secured inside the hollow interior 114 of the lower member 76. The push pin assembly 118 includes a generally C-shaped spring 120 having a push pin 122 welded or secured to one end of the generally C-shaped spring 120. As best shown in FIGS. 5 and 8, the generally C-shaped spring 120 resides inside the hollow interior 114 of lower member 76, the push pin 122 of push pin assembly 118 extending through one of the two openings 124 in the lower member 76. When the leg assembly 18 is fixed at a desired height, the push pin 122 of push pin assembly 118 also extends through one of the holes 92 of receiver 94. The leg assembly 18 stays at its desired height when the adjustable bed is in use. Because the push pin 122 of push pin assembly 118 extends through both one of the openings 124 in the lower member 76 and through one of the holes 92 of receiver 94, the lower member 76 is fixed relative to the receiver 94. The lower member 76 only moves when an operator pushes in the push pin 122 and then moves the receiver 94 so the push pin 122 extends through a different hole 92 of receiver 94.

Each leg assembly 18 may further comprise a riser 142 which has a cavity 144 for receiving a lower portion of the lower member 76 of leg assembly 18. Although in the embodiment of adjustable bed 10 shown, two of six leg assemblies 18 of adjustable bed base 12 are illustrated having a riser 142, four or six of the leg assemblies 18 may have a riser 142. Alternatively, none of the leg assemblies 18 may have a riser 142.

As best shown in FIGS. 3 and 3A, regardless of the position of the deck 30 the head end 13 of the generally rectangular frame 16 is above the foot end 15 of the generally rectangular frame 16 due to the wedges 72 or 72'. Alternatively, the wedges 72 or 72' may be oriented to keep the generally rectangular frame 16 in a declined position such that the foot end 15 of the generally rectangular frame 16 is above the head end 13 of the generally rectangular frame 16 due to the wedges 72 or 72'.

Although the drawings illustrate only leg assemblies having adjustable lengths, it is within the scope of the present invention that unitary legs, not adjustable in length, may be used in accordance with the present invention.

As best shown in FIGS. 3 and 3A, a pair 21 of leg assemblies 18 proximate the head end 13 of the generally rectangular frame 16 are adjusted in length to be a length L1. Another pair 23 of leg assemblies 18 proximate the foot end 15 of the generally rectangular frame 16 are adjusted in length to be a length L2 less than the length L1. A middle pair 25 of leg assemblies 18 between the head and foot ends 13, 15 of the generally rectangular frame 16 are adjusted in length to be a length L3 which is greater than length L2 and less than length L1.

As shown in FIGS. 4A and 4B, in order to secure one of the leg assemblies 18 to one of the mounting brackets 64 of the generally rectangular frame 16 of the adjustable bed base 12, the fastener 100 of the receiver 74 of the leg assembly 18 extends through the oval shaped opening 126 in the main portion 128 of wedge 72 and into the threaded boss 70 of the mounting bracket 64. The external threads 104 of fastener 100 engage the internal threads of the threaded boss 70 of the mounting bracket 64 so that upon rotation of the leg assembly 18, the leg assembly 18 is secured to the mounting bracket 64 with the wedge 72 sandwiched therebetween.

As best shown in FIG. 4B, the wedge 72 is sized so that one of the wings 130 abuts an outer surface 23 of one of the side members 22 of the generally rectangular frame 16. The other wing 130 of the wedge 72 abuts an inner edge of one of the mounting brackets 64. This alignment helps keep the wedge 72 in place and enables a user to quickly and easily pass the fastener 100 of the leg assembly 18 through the oval shaped opening 126 of the wedge 72 and into the threaded boss 70 of the mounting bracket 64.

All the wedges of adjustable bed 10 are identical to impart the desired angle of inclination or declination to the adjustable bed base 12. In the illustrated embodiment of adjustable bed 10, six wedges 72 are shown. However, six wedges 72' could be used to impart a different angle of inclination or declination to the adjustable bed base 12.

As best shown in FIGS. 5 and 6, upon assembly, the bottom surface 140 of wedge 72 stays horizontal or parallel the floor or supporting surface 3. The bottom surface 140 of wedge 72 abuts and contacts the upper edge 78 of receiver 74 of leg assembly 18. As best shown in FIG. 4B, the upper surface 138 of the main portion 128 of wedge 72 contacts and remains flush with a lower surface 19 of a side member 22 of generally rectangular frame 16. Additionally, the upper surface 138 of the main portion 128 of wedge 72 contacts and remains flush with the lower surface 67 of floor 66 of mounting bracket 64. As best shown in FIGS. 5 and 6, due to the construction of the wedge 72, upon assembly, the leg assembly 18 remains in a generally vertical orientation, providing stability to the leg assembly 18. In addition, the mounting bracket 24 and side member 22 of the generally rectangular frame 16 remain inclined. The generally rectangular frame 16 remains inclined at an angle 8 determined by the construction of the wedges and remains stationary regardless of the positions of the deck members. As seen in FIG. 6, the lower surfaces 19 of side members 22 of the generally rectangular frame 16 remains inclined at an angle 8 relative to a horizontal plane P.

Figure 9:
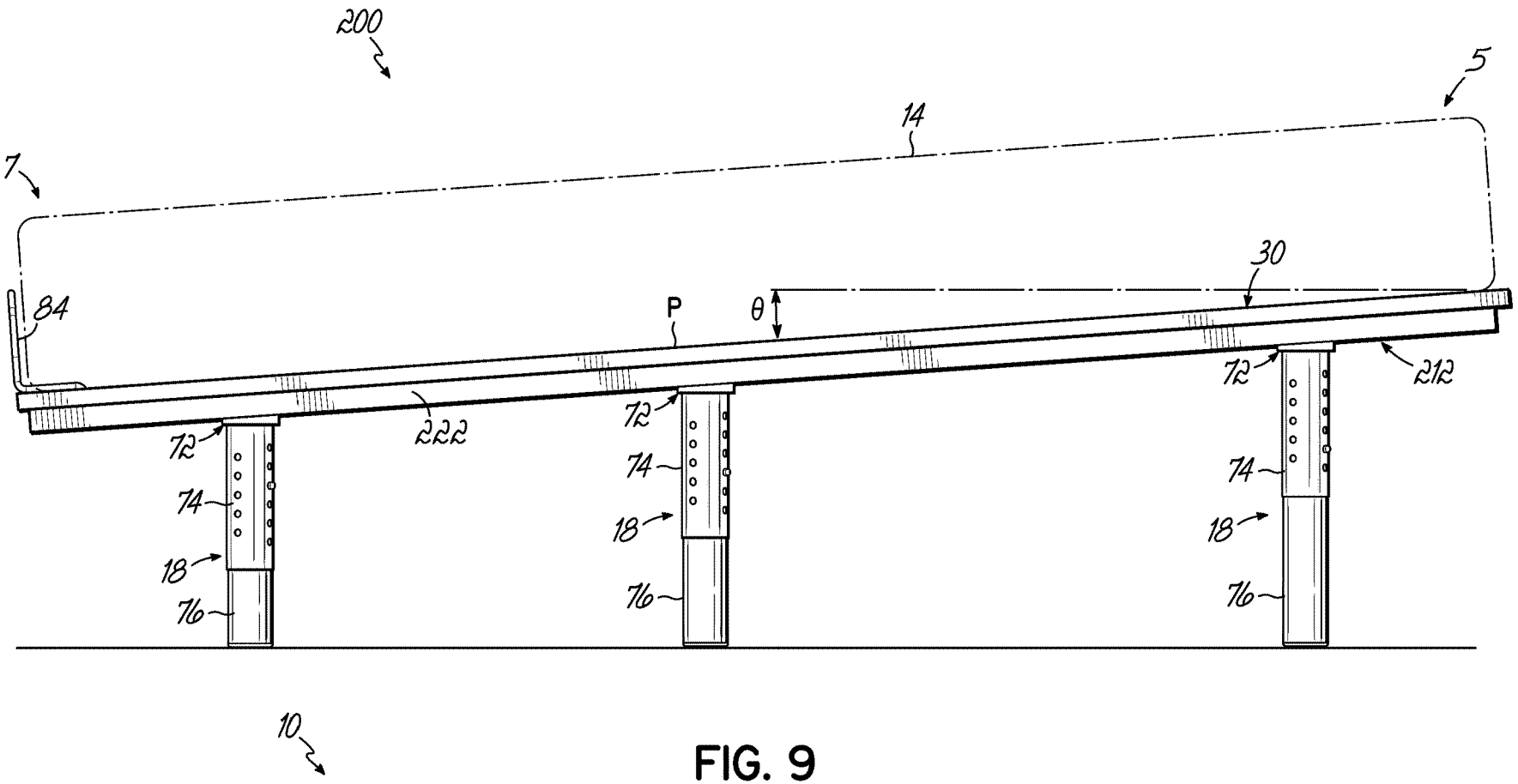
FIG. 9 is a side view of a bedding foundation constructed in accordance with the present invention.
Figure 9A:
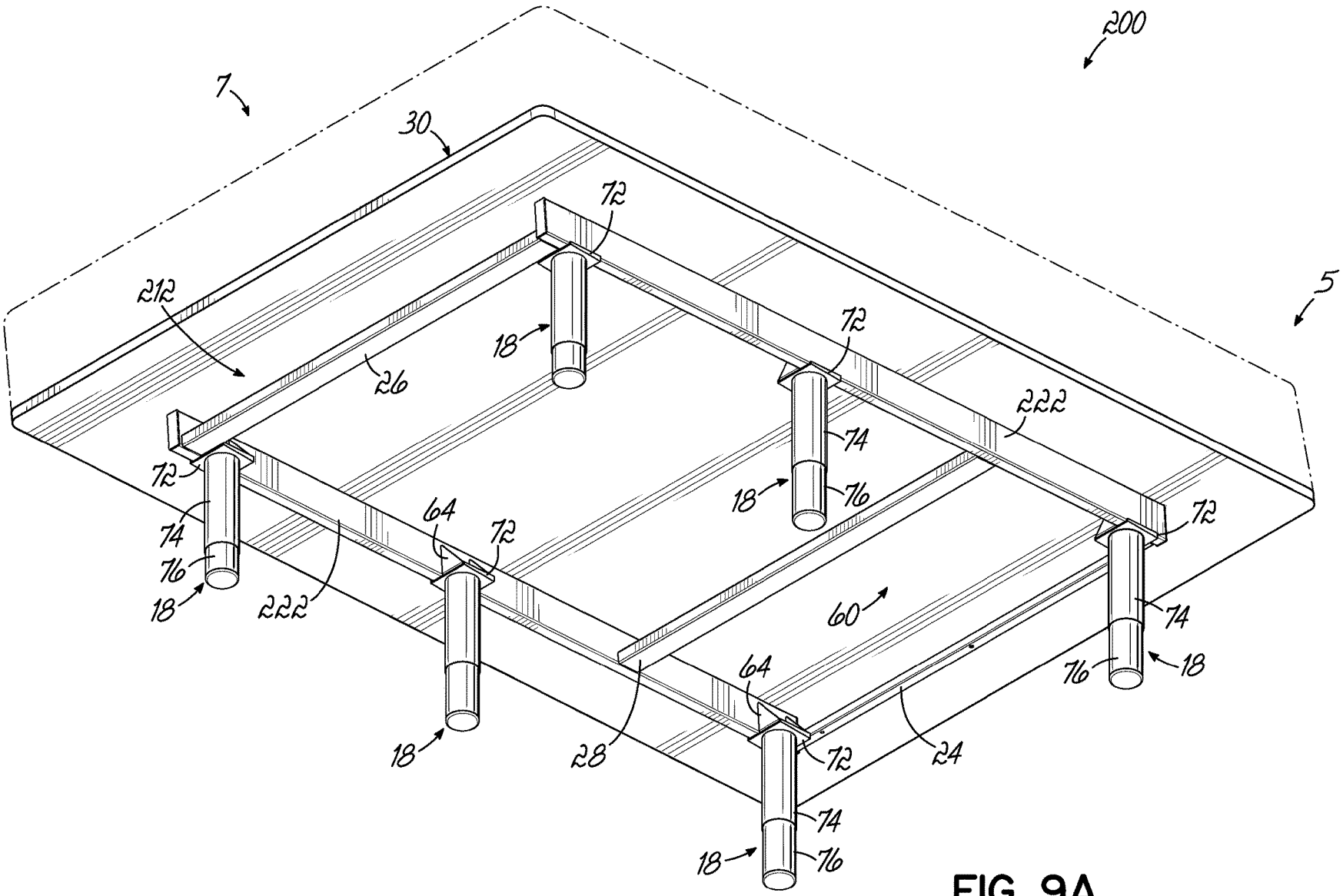
FIG. 9A is a bottom perspective view of the bedding foundation of FIG. 9.

FIGS. 9 and 9A illustrate a bedding foundation 200 constructed in accordance with the present invention. The bedding foundation 200 has the same parts as the adjustable bed 10 but a different bed base 212. The bed base 212 is the similar to adjustable bed base 12 but has a unitary deck member 230 in place of an articulated deck 30 and frame side members 222 which are not hinged. For simplicity like numbers represent like parts.

Although none of the leg assemblies 18 of bedding foundation 200 are illustrated having a riser 142, it is within the scope of the present invention that two, four or all six leg assemblies of bedding foundation 200 may have risers 142. It is also with the scope of the present invention that bedding foundation 200 may be foldable with hinged frame side members and a foldable deck.

The adjustable bed base 12 may be shipped in a container 300. FIG. 10 illustrates container 300 showing the adjustable bed base 12 folded in half or in a collapsed position with the leg assemblies 18 and wedges 72 separated from the adjustable bed base 12. Although FIG. 10 shows the adjustable bed base 12 folded a certain direction, those skilled in the art will appreciate that the adjustable bed base may be folded the other direction. The container 300 includes six leg assemblies 18 including six risers 142 and six wedges 72. Although not shown, the risers may be packaged in plastic and so may be the wedges and the leg assemblies for protection during shipping.

Alternatively, the container 300 may contain only two or four risers 142 or any number of risers 142. The container 300 may be shipped via United Parcel Service or any other shipping company and assembled at the destination without tools. In some applications, four or eight or any number of leg assemblies 18 and risers 142 and wedges 72 may be shipped in the container depending upon the design of the adjustable bed or bedding foundation. The size and configuration of container 300 are not intended to be limited by the drawings. Any size container may be used of any shape.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of any and all of those features. Accordingly, the scope of the invention shall be limited only by the following claims and their equivalents.

What is claimed is:

1. An adjustable bed base comprising:

a stationary frame having mounting brackets;

multiple leg assemblies, each of the leg assemblies being secured to one of the mounting brackets and being supported by a support surface; and multiple wedges, each of the wedges being a unitary member having a main portion and two wings extending upwardly from the main portion, the main portion of the wedge having a planar upper surface and a planar bottom surface which define an angle such that the main portion of the wedge has a tapered thickness, each of the wedges being sandwiched between one of the leg assemblies and one of the mounting brackets to incline the stationary frame relative to the support surface and keep a bottom surface of the leg assembly flat on the support surface regardless of the length of the leg assembly.

2. The adjustable bed base of claim 1, wherein each of the leg assemblies has an adjustable length.

3. The adjustable bed base of claim 1, further comprising a deck comprising multiple deck members hinged to each other, at least one of the deck members being secured to the stationary frame.

4. The adjustable bed base of claim 1, wherein each of the wedges has an opening therethrough which allows a portion of one of the leg assemblies to pass through the opening in the wedge and engage one of the mounting brackets.

5. The adjustable bed base of claim 4, wherein one of the wings of each of the wedges abuts an outer surface of one of the side members of the frame and the other wing abuts an inner edge of one of the mounting brackets to keep the wedge stationary.

6. The adjustable bed base of claim 5, wherein the opening extends through the floor of the wedge.

7. The adjustable bed base of claim 3, wherein the stationary frame has a head end and a foot end, one of the head and foot ends being higher than the other of the head and foot ends, regardless of the positions of the deck members.

8. An adjustable bed base comprising:

a stationary frame including multiple mounting brackets welded to the stationary frame:

a threaded boss welded to each of the mounting brackets;

multiple leg assemblies legs, each of the leg assemblies legs comprising a receiver, a lower member and a push pin assembly secured inside a hollow interior of the lower member;

multiple wedges, each of the wedges being sandwiched between one of the leg assemblies and one of the mounting brackets, the wedges keeping an upper surface of the stationary frame in an inclined position relative to a horizontal support surface, a threaded fastener of the receiver extending through an opening in a main portion of the wedge and into the threaded boss of the mounting bracket to secure one of the leg assemblies to one of the mounting brackets.

9. The adjustable bed base of claim 8, wherein each of the leg assemblies has an adjustable height.

10. The adjustable bed base of claim 8, wherein each of the wedges has a floor, lips extending upwardly from the floor on opposite sides of the floor and an opening extending through the floor which allows a portion of one of the leg assemblies to pass through the opening in the wedge and engage one of the mounting brackets.

11. The adjustable bed base of claim 8, further comprising a deck comprising multiple deck members hinged together, at least one of the deck members being secured to the stationary frame.

12. The adjustable bed base of claim 8, wherein the stationary frame has a head end and a foot end, one of the head and foot ends being at least two degrees higher than the other of the head and foot ends.

13. The adjustable bed base of claim 8, wherein the adjustable bed base has six leg assemblies.

14. An adjustable bed movable between multiple positions, the adjustable bed comprising:

an adjustable bed base comprising a stationary frame having opposed side members, a head end member extending between the side members and a foot end member extending between the side members;

multiple mounting brackets, each of the mounting brackets being welded to one of the side members of the stationary frame, each of the mounting brackets being a generally U-shaped unitary member having a floor and two triangular side walls extending upwardly from the floor;

multiple leg assemblies, each of the leg assemblies being secured to one of the mounting brackets;

multiple wedges, each of the wedges being a unitary member having a main portion having a tapered thickness, the wedge being sandwiched between one of the leg assemblies and one of the mounting brackets to incline the stationary frame relative to a planar support surface regardless of the position of the adjustable bed.

15. The adjustable bed of claim 14, wherein each of the wedges has a floor, lips extending upwardly from the floor on opposite sides of the floor and an opening extending through the floor which allows a portion of one of the leg assemblies to pass through the opening in the wedge and engage one of the mounting brackets.

16. The adjustable bed of claim 14, wherein each of the wedges is identical.

17. The adjustable bed of claim 14, further comprising: a deck comprising multiple deck members hinged together, at least one of the deck members being secured to the stationary frame; and at least one linear actuator for moving the deck members such the deck may assume a planar position and at least one other desired deck position.

18. The adjustable bed of claim 17, wherein the wedges are stationary relative to the frame regardless of the position of the deck.

19. The adjustable bed base of claim 14, wherein some of the leg assemblies are different lengths than other of the leg assemblies.

20. The adjustable bed of claim 14, wherein each of the wedges has two wings extending upwardly from the main portion, the main portion having a planar upper surface and a planar bottom surface which define an angle between two and four degrees.

* * * * *